US006024312A

United States Patent [19]

Spiesshofer

[11] Patent Number: 6,024,312

[45] Date of Patent: Feb. 15, 2000

[54] ROTOR SHEAR FOR COMMINUTING PARTICULARLY BULKY WASTE MATERIAL

[75] Inventor: Thomas Spiesshofer, Dormagen, Germany

[73] Assignee: Svedala Lindemann GmbH, Dusseldorf, Germany

[21] Appl. No.: 08/617,762

[22] Filed: Mar. 6, 1996

Related U.S. Application Data

[63] Continuation-in-part of application No. PCT/DE95/00833, Jun. 30, 1995.

[30] Foreign Application Priority Data

Jul. 6, 1994 [DE] Germany ..... 44 23 424

[51] Int. Cl.[7] ..... B02C 18/16

[52] U.S. Cl. ..... 241/166; 241/236; 241/253

[58] Field of Search ..... 241/166, 167, 241/236, 293, 294, 295; 83/501, 502

[56] References Cited

U.S. PATENT DOCUMENTS

| | | | |
|---|---|---|---|
| 4,925,116 | 5/1990 | Lundell . | |
| 5,110,060 | 5/1992 | Lundquist . | |
| 5,152,469 | 10/1992 | Dicky | 241/236 |

FOREIGN PATENT DOCUMENTS

| | | |
|---|---|---|
| 2 428 469 | 6/1978 | France . |
| 2 716 125 | 4/1996 | France . |
| 24 50 936 | 4/1975 | Germany . |
| 39 18 657 | 12/1990 | Germany . |
| 2 053 727 | 2/1981 | United Kingdom . |

*Primary Examiner*—Mark Rosenbaum
*Attorney, Agent, or Firm*—Darby & Darby

[57] ABSTRACT

A rotor shear for comminuting particularly bulky waste materials is formed by two cutting rotors (2) combing each other, disposed parallel to each other, supported in a housing (1), and each driven in an opposite direction. Each cutting rotor (2) comprises spacer rings (4) and rotor disks (5) furnished with cutting teeth (6). A face of a front flank (61) of at least one cutting tooth (6) is furnished with geometrically staggered and/or angled partial faces (65). The spacer rings (4) and the rotor disks (5) are disposed on shafts (3). Wear disks (7) are coordinated to outer rotor disks (5) with corresponding circumferences and are connected to the shaft (3). The cutting teeth (6) operate against the circumference of the spacer rings (4) disposed between the rotor disks (5). At least one support device/stripper device (8) is coordinated with at least one shaft (3), where support parts (81) and stripper parts (82) of the support device/stripper device (8) are functionally separated.

37 Claims, 9 Drawing Sheets

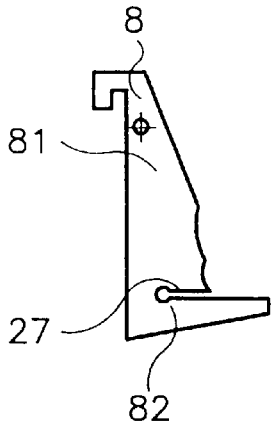
FIG. 3a
FIG. 3b
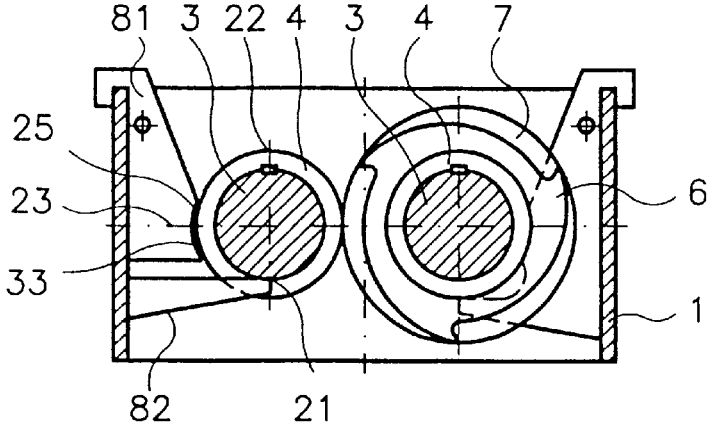
FIG. 3c
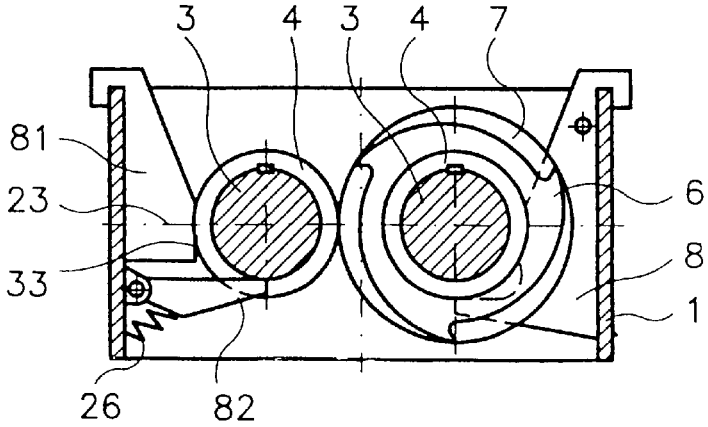

ROTOR SHEAR FOR COMMINUTING PARTICULARLY BULKY WASTE MATERIAL

CROSS-REFERENCE TO RELATED APPLICATION

This application is a continuation-in-part application of another international application filed Jun. 30, 1995 under the Patent Cooperation Treaty and bearing application No. PCT/DE/95/00833. The entire disclosure of this application, including the drawings thereof, is hereby incorporated in this application as if fully set forth herein.

BACKGROUND OF THE INVENTION

1. Field of the Invention

The invention relates to a rotor shear for the comminuting of particularly bulky waste materials with at least two cutting rotors, disposed parallel to each other in a housing and driven in opposite rotation directions, and where the cutting rotors are engaging like combs, wherein the cutting rotors in each case are comprising a plurality of rotor disks, furnished with cutting teeth and operating against each other and against the circumference face of the oppositely disposed shaft or, respectively, distance rings, wherein the cutting rotors are disposed successively on a shaft at a distance relative to each other.

2. Brief Description of the Background of the Invention Including Prior Art

Rotor shears are known and are employed predominantly for the comminuting of waste materials, such as bulky refuse, domestic refuse, old tires, bottles, and containers of metal, plastic, and the like. Based on the different materials contained in the bulky waste material, which are frequently very resistant and very tough, such as bulky steel parts, steel insertions in old tires and the like, there result big problems with respect to the radial forces and the axial forces to be accepted as well as with respect to wear, which in the final analysis have an adverse effect on the comminuting process and interfere substantially with the availability of a rotor shear.

It has been continuously attempted to counteract the problems of the extremely high load and of the wear, and there resulted, based on the steps proposed in the German patent DE 27 31 588 C2, providing a two-part construction of the housing, furthermore the embodiment of protective caps for the cutting teeth according to the German patent DE 39 18 657 C2 and, finally, the proposal corresponding to the German patent P 42 40 444.4-23, to employ cutting rotors with an overdimension.

Even if these solutions effect in detail improvement, at the present time, a complex solution is lacking, which substantially eliminates the above recited problems.

SUMMARY OF THE INVENTION

1. Purposes of the Invention

It is an object of the invention to constructively structure a rotor shear of the initially recited kind such that the respectively changed machine elements lead to an effective comminuting process, an optimum wear, and a reduction in the bearing load.

These and other objects and advantages of the present invention will become evident from the description which follows.

2. Brief Description of the Invention

According to the invention, these problems can be resolved by three related and coordinated embodiments.

According to the first variant, it is proposed to coordinate a wear disk at least to one outer rotor disk of a cutting rotor, where the circumference of the wear disk corresponds to the circumference of the rotor disk, and to connect the wear disk to a shaft of the cutting rotor in order to reduce the wear, in order to enhance the comminuting process, and in order to lower the bearing load based on reduced axial forces.

These embodiments are advantageous in that:

- no jamming of the comminuting material, as conventionally occurrs between fixed wear elements and the cutting rotor, can occur and the wear becomes less;
- the acting axial forces are thereby decreased and the lifetime of the bearings is increased;
- the overall effect of the comminuting process is thus improved; and
- the rotor shear obtains a higher availability.

In the first embodiment of the invention, the wear disc is form-matchingly or force-matchingly connected to the shaft with, the wear disc attached by way of a thread to the shaft, or the wear disc is a collar-like or a flange-like part of the shaft.

The wear disc runs in a passage of the separating wall delimiting the comminuting chamber or against an outer spacer ring of the oppositely disposed shaft with or without play. Two outer wear discs may be coordinated to the shaft, which in each case run with or without play against corresponding outer spacer rings of the oppositely disposed shaft.

In a second embodiment one support/stripper device is coordinated at least to one shaft such that the support/stripper device surrounds with a functionally autonomous support part the shaft or, respectively, the spacer ring in a sector between lower "dead point" and horizontal symmetry line, and with a stripper part, which is functionally independent from the support part, in the region of the lower "dead point" of the shaft or, respectively, the spacer ring.

This construction is beneficial in that it results in

- a lowering of the wear based on the avoiding of jammings of the material to be comminuted;
- a higher lifetime of the bearings based on the reduction of the load of the shaft; and
- a more effective comminuting process or, respectively, a higher availability of the rotor shear.

The support/stripper device, according to the invention, may be formed as a constructive unit while the support part and the stripper part are functionally decoupled.

The support part and the stripper part may be disposed in the center relative to the length of the shaft.

The support part and the stripper part, relating to the length of the shaft, may be multiply coordinated to the shaft or to the spacer rings.

A sliding layer may be interposed between the support part and the shaft or, respectively, the spacer ring.

A sliding coating may be applied onto the support part.

Preferably, the stripper part is not loaded under the horizontal bending through of the shaft and is not interfered with in its functioning upon wear of the support part. The stripper part may be adjusted relative to the shaft or relative to the spacer rings. The stripper part may also be supported against a spring and may be formed as a springing device component.

The support/stripper device may be recessed between the support part and the stripper part relative to the shaft or, respectively, to the spacer ring.

The recess is substituted by two-sided bevelled inclinations with a ridge line running perpendicular to the shaft axis.

An additional rake-like stripper part is disposed in the region of the upper "dead point" of the shaft or, respectively, of the spacer rings for reverse operation.

The support/stripper device and/or parts thereof are supported at the housing.

According to the third embodiment of the invention, the surface of the front tooth flank comprises at least one cutting tooth made of geometrically staggered and/or angled partial faces, which lead to a step-by-step comminution and an optimum effect of the comminuting edges and partial faces participating in the comminuting process.

Based on the changed geometry of the teeth, in the final analysis also the availability of the rotor shear is substantially increased based on an optimum comminution process;

smaller bearing loads; and a more favorable wear behavior.

In an embodiment according to the invention for realizing the principle of step-by-step comminution the comminuting edges and the partial faces of the front tooth flank are staggered like steps.

Steps or are staggered nearly parallel like steps relative to the front face with an intermediately disposed inclined partial face.

The comminuting edges and the partial faces of the front tooth flank may also be formed convex for a predominant breaking effect, or concave nearly wedge-like for a predominantly cutting effect.

Several cutting teeth, with in each case identical or differing structures of the comminuting edges and of the partial faces, can be present on the rotor disk.

Preferably, at least two rotor discs are combined to a construction unit.

Staggered cutting teeth, can be provided in a circumferential direction.

The angles between the partial faces of the front tooth flank and the front face may be set to approximately or precisely 90 degrees.

The rotor discs, composed into one constructing unit, can be composed after the wear of the outer comminuting edges with the front faces of the worn outer comminuting edges.

A rotor shear for comminuting in particular bulky waste materials can include at least two cutting rotors combing each other, driven in opposite rotation directions and supported substantilly parallel to each other in a housing. The cutting rotors in each case can be composed of a plurality of rotor disks with cutting teeth operating against each other and against the circumference face of the oppositely disposed shaft, or, respectively, of a spacer ring. The cutting rotors are disposed successively on a shaft with adjacent cutting rotors seperated by a distance relative to each other.

At least at one outer rotor disk of a cutting rotor can be coordinated a wear disc having a circumference substantially equal to that of the rotor disc. The wear disc can be connected to the shaft. The disposition of the wear disk leads to a reduction in wear thereby enhancing the comminuting process, and lowers the load on the bearings based on reduced axial forces.

At least one support/stripper device can be coordinated to at least one shaft for decreasing the wear, for decreasing the load of the shaft and of the bearing, and for improving the comminution process such that this support/stripper device surrounds with a functionally autonomous support part the shaft or, respectively, the spacer ring in a sector between a lower "dead point" and a horizontal symmetry line, and with a stripper part, functionally independent from the support part, in the region of the lower "dead point" of the shaft or, respectively, of the spacer ring.

The face of the front tooth flank of at least one of the cutting teeth can comprise geometrically staggered and/or angled partial faces, which lead to a step-by-step comminution and an optimum effect of the comminuting edges and of the partial faces participating at the comminuting process.

It has been shown to be advantageous that the effects of the aforecited features of the invention favorably influence the availability of a rotor shear, if the recited three individual solutions are combined as a preferred embodiment in a machine. The therefrom resulting surprising and new effect includes that the comminuting process can be adjudged to the various material kinds of the material mixture to be comminuted while maintaining the advantageous effects, such as a favorable wear behavior, smaller bearing loads, and improved comminuting process. The particularly high availability of a rotor shear is thereby achieved, because the rotor shear is constructed in an optimum way with respect to the material mixture to be comminuted or, respectively, designed dependent on the material mixture to be comminuted.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 3*a* is a partial sectional view of a support/stripper device having a structure of a device unit;

FIG. 3*b* is a partial sectional view of an embodiment of a support/stripper device having a structure employing a separate support part and a separate stripper part;

FIG. 3*c* is a partial sectional view of an embodiment of a support/stripper device having a structure of a device unit with an additional stripper part for reverse operation;

DESCRIPTION OF INVENTION AND PREFERRED EMBODIMENT

Figure 1:
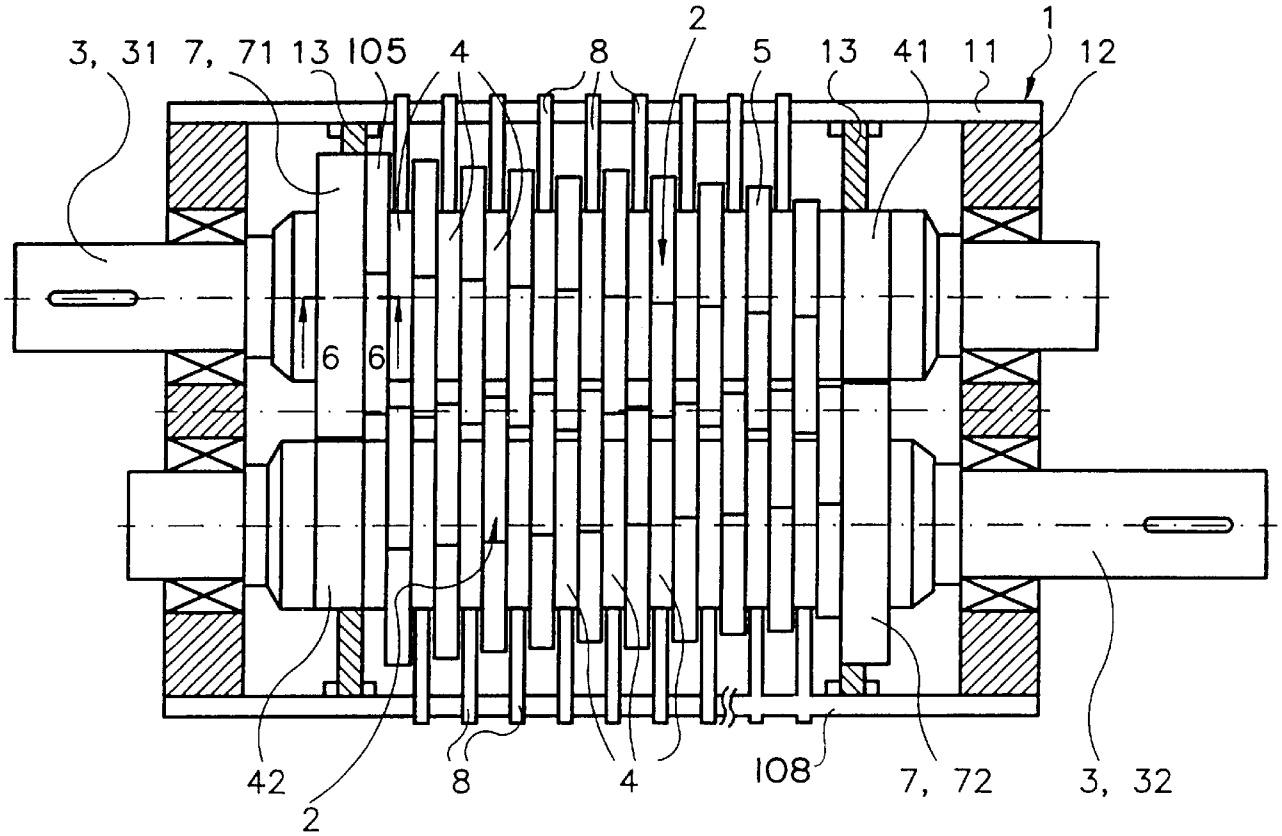
FIG. 1 is schematic top plan view of an open rotor shear.
Figure 2A:
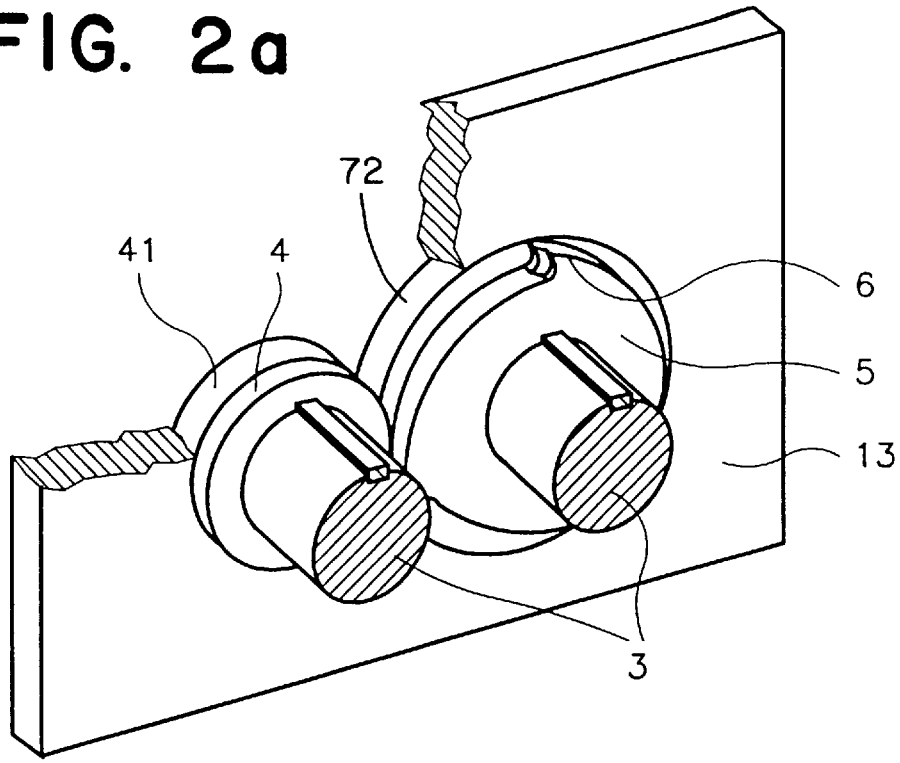
FIG. 2*a* is a fragmentary perspective view of a cutting disk with a wear disk.

In accordance with the present invention, there is provided a rotor shear for reducing the size of bulky waste material. As shown in FIG. 1, a rotor shear comprises essentially a first plurality of cutting disks forming a first cutting rotor 2 and a second plurality of cutting disks 5 forming a second cutting rotor 2, wherein the rotor disks of the first plurality of cutting disks 5 of the first rotor 2 are aligned on a first axis, and wherein the rotor disks of the second plurality of cutting disks 5 of the second cutting rotor 2 are aligned along a second axis. The first axis and the second axis are disposed parallel to each other. The first cutting rotor 2 and the second cutting rotor 2 are supported in a housing 1. Each cutting rotor 2 is constructed such that a rotation in a first direction results in a cutting action. The first plurality of the cutting disks 5 of the first cutting rotor 2 all have a first common direction of rotation and the second plurality of the cutting disks 5 of the second cutting rotor 2 have a second common direction of rotation, wherein the first common direction of rotation is directed opposite to the second common direction of rotation. The first plurality of rotor disks 5 is driven in a first cutting direction and the second plurality of rotor disks 5 is driven in a second cutting direction, and thus the first plurality of rotor disks 5 and the second plurality of rotor disks 5 are driven in opposite directions of rotation. The cutting rotor disks 5 of the first cutting rotor 2 are combing between the cutting rotor disks 5 of the second cutting rotor 2 and vice versa. The rotor disks 5 are furnished with cutting teeth 6 (FIG. 2). The first cutting rotor 2 further comprises first spacer rings 4, and the second cutting rotor 2 further comprises second spacer rings 4. The spacer rings 4 are generally disposed between two neighboring cutting rotor disks 5. Thus, the first cutting rotor disks 5 are facing the second spacer rings 4 and the second cutting rotor disks 5 are facing the first spacer rings 4. The first spacer rings 4 and the first rotor disks 5 are disposed on a first shaft 3, 31, and the second spacer rings 4 and the second rotor disks 5 are disposed on a second shaft 3, 32. The first cutting rotor disks 5 are working against the second cutting rotor disks 5 by moving in the same direction in a region of overlapping as seen in an axial direction of the cutting rotors 2. The cutting teeth 6 face and operate against the circumference of the spacer rings 4 disposed on the other shaft between the cutting rotors 2.

The housing 1 is furnished with rear walls 1.1 disposed parallel to the axial direction of the shafts 3 and disposed perpendicular to the plane spanned by the axes of the two shafts 3, 31, 32, with front walls 12 disposed perpendicular to the axes of the shafts 3, and with separating walls 13 disposed perpendicular to the axes of the shafts 3, 31, 32 and disposed parallel to the front walls 12. The walls 11, 12, 13 are disposed in pairs on opposite sides of the housing 1. The walls 13 are disposed between the walls 12. The shafts 3 are supported in the front walls 12. Antifriction bearings are mounted in the front walls 12 for supporting the shafts 3. The rotor disks 5 forming the cutting rotors 2 are spaced by way of the spacer rings 4.

Figure 6:
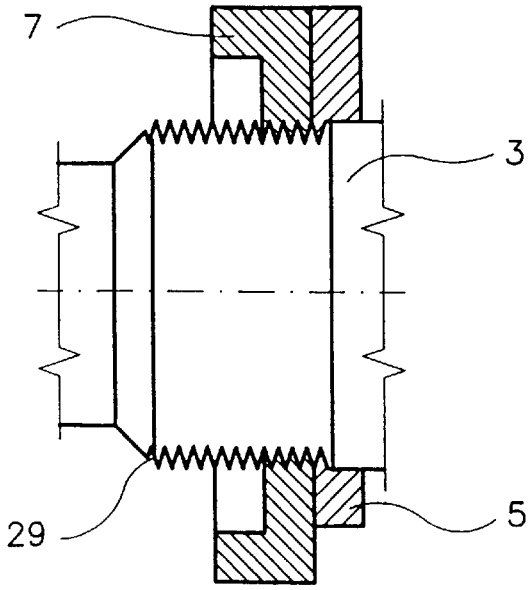
FIG. 6 is an other embodiment of the wear disk attached to the shaft by way of a thread as viewed along line 6—6 of FIG. 1 at an enlarged scale.

The first cutting rotor 2 illustrated in FIG. 1 exhibits on a first end of the first shaft 3 a first wear disk 71, which joins immediately next to a first outer rotor disk 105 of the second cutting rotor 2 and is connected shape-matchingly or force-matchingly (FIG. 2) or by way of a thread, shown in FIG. 6, to the first shaft 3. The first outer rotor disk 105 corresponds in its properties to the other rotor disks 5 and is distinguished by its position immediately neighboring the first wear disk 71. An outer diameter of this first wear disk 71 corresponds to an outer diameter of the first outer rotor disk 105. Advantageously, the outer diameter of the first wear disk 71 has a slightly larger diameter as compared to the outer diameter of the first outer rotor disk 105. The diameter of the wear disk 71, 72 can be from about 1.01 to 1.05 times the diameter of the rotor disks 5. The first wear disk 71 runs with or without play against a second outer spacer ring 42 of the oppositely disposed second shaft 32. The wear disk 71, 72 allows to remove the shaft 3, 31, 32 when desired from the housing 1.

The second outer spacer ring 42 preferably exhibits the same outer diameter as do the spacer rings 4. As shown in FIG. 1, the second outer spacer ring 42 can be adjoining to a spacer ring 4 disposed facing the first outer rotor disk 105 or, alternatively, the second outer spacer ring 42 can be made of a single piece for facing both the first outer rotor disk 105 and the first wear disk 71. The thickness of the wear disk can be from about 1 to three times the thickness of the rotor disks 5 and is preferably from about 1.5 to 2.5 times the thickness of the rotor disks 5. The thickness of the wear disk can be from about 1 to 3 times the thickness of the separating wall 13 and is preferably from about 1.5 to 2.5 times the thickness of the separating wall 13.

The second cutting rotor 2 illustrated in FIG. 1 exhibits on a first end of the second shaft 3 a second wear disk 72, which joins immediately next to a second outer rotor disk 105 of the second cutting rotor 2 and is connected shape-matchingly or force-matchingly (FIG. 2) or by way of a thread, shown in FIG. 6, to the second shaft 3. The second wear disk 72 is disposed and formed in a corresponding way as to disposition and form of the first wear disk 71. The second outer rotor disk 105 corresponds in its properties to the other rotor disks 5 and is distinguished by its position immediately neighboring the second wear disk 72. An outer diameter of this second wear disk 72 corresponds to an outer diameter of the second outer rotor disk 105. Advantageously, the outer diameter of the second wear disk 72 has a slightly larger diameter as compared to the outer diameter of the second outer rotor disk 105. The second wear disk 72 runs with or without play against a first outer spacer ring 41 of the oppositely disposed first shaft 31, where the first outer spacer ring 41 is disposed at a second end of the first shaft 31. The first outer spacer ring 41 preferably exhibits the same outer diameter as do the spacer rings 4. As shown in FIG. 1, the first outer spacer ring 41 can be adjoining to a spacer ring 4 disposed facing the second outer rotor disk 105 or, alternatively, the first outer spacer ring 41 can be made of a single piece for facing both the second outer rotor disk 105 and the second wear disk 7.

The first wear disk 71 runs in a corresponding and size-matching first opening of a first one of the separating walls 13 delimiting the comminuting chamber. The separating wall 13 together with a wear disk 71, 72 operates as an additional support of the shaft 3, 31, 32 and the load on the bearing of the shaft 3, 31, 32 is thereby decreased. A separating wall 13 prevents the bearings located in the front wall from entanglement with material to be comminuted or with comminuted material. The second wear disk 72 runs in a corresponding and size-matching second opening of a second one of the separating walls 13 delimiting the comminuting chamber. The two wear disks furnish together with spacer rings 41, 42 additional supports for the shafts 31, 32 and the load exerted on the bearings is thereby decreased. The lifetime of the bearings is increased by the smaller axial forces. Also, the wear disks 71, 72 protect or shield the bearings from particles of the comminuting material. In addition, embodiments are possible, wherein the wear disks 71, 72 are formed as a collar-like or a flange-like part attached to the respective shaft 3, 31, 32 as shown in FIG. 6.

The embodiment shown in FIG. 1 can also be conceived such that the first shaft is associated with the first wear disk 71 at its first end and with the second wear disk 72 at its second end. In this case, the second shaft 32 is furnished at its first end with a first outer spacer ring 41 and at its second end with a second outer spacer ring 42. In this case, the outer wear disks 71, 72 of the first shaft 31 run in each case with or without play against the corresponding outer spacer rings 41, 42 of the oppositely disposed second shaft 32. The invention concept can also be transferred to the rotor shears, which include a plurality of pairs of cutting rotors 2. Finally, it is within the scope of the construction according to the invention that the respective wear disk 71, 72 does not rest immediately at the respective outer rotor disk 105 but is separated from the outer rotor disk 105 by a spacer ring 4 or, respectively, an outer spacer ring 41. In this case, a rotor disk 5, disposed opposite to this spacer ring 4 or, respectively, outer spacer ring 41, then abuts practically sealingly to the respective separating wall 13. It is essential that at most two wear disks 71, 72 are coordinated to one pair of combing cutting rotors 2, wherein the wear disks 71, 72 in each case rest at an outer rotor disk 105 and follow to the outer rotor disk 105 in the direction toward a nearby disposed front wall 12, and wherein the wear disks 71, 72 are solidly connected to the respective shaft 3, 31, 32.

It has been found based on this construction that jammings of the material to be comminuted, as have been observed in the past between the fixedly disposed wear elements and the cutting rotor 2, can be avoided based on the construction of the present invention and the wear of the housing can be substantially reduced by employing the construction of the present invention. The lifetime of the bearings is increased by the smaller axial forces. The present invention overall improves the comminution process and, based on this alone, the rotor shear machine of the present invention exhibits increased availability periods for usage as compared with the limited availability for usage of conventional machines associated with shorter lifetimes of the parts employed.

These effects are further functionally supported during the comminution process by support/stripper devices 8 according to the invention, which are, according to FIG. 1, disposed between the rotor disks 5. According to the features of the invention, each embodiment is constructed such that the functions of supporting and stripping are decoupled, that is, the support and stripper device according to FIGS. 3*a*, 3*c* includes a functionally autonomous support part 81 and a functionally autonomous stripper part 82. The spacer ring 4 is supported in sector 33, between a lower "dead point" 21 (FIG. 3*e*) and a horizontal symmetry line 23, by the support part 81 and is supported in the area of the lower "dead point" 21 of the spacer ring 4 with the functionally independent stripper part 82.

Figure 3D:
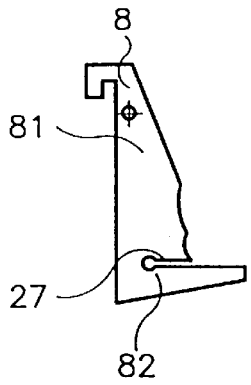
FIG. 3*d* is an elevational view of an embodiment of a support/stripper device having a structure of a device unit with a recess.
Figure 3E:
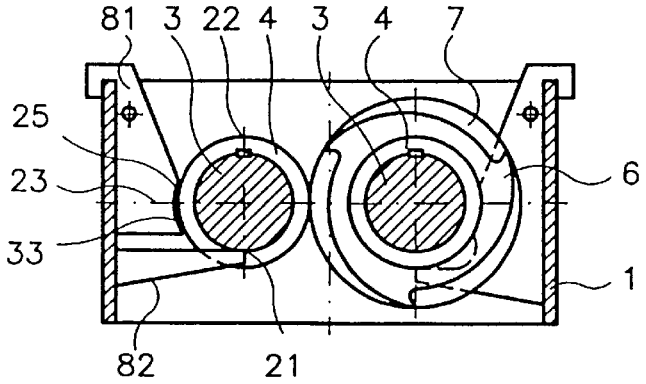
FIG. 3*e* is a partial sectional view of an embodiment of a support part having a sliding layer and a stripper part attaching the shaft.
Figure 3F:
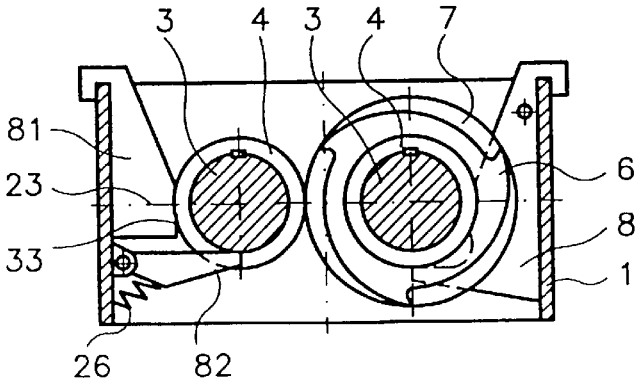
FIG. 3*f* is a partial sectional view of an embodiment of a stripper part supported against a spring.

The support/stripper device 8, shown in FIGS. 3*a*, and 3*d*, is formed as a construction unit. The support part 81, forming a support device, is disposed relative to the spacer ring 4 as shown in FIGS. 3*a*, 3*c*, 3*e*, 3*f* or to the shaft 3 as shown in FIGS. 3*b* in a region of a horizontally running symmetry line 23 of the shaft 3. The support device can be formed as a separated part as shown in FIGS. 3*b*, 3*e* and 3*f*.

The support part 81 is formed shape matching relative to the shaft 3 or, respectively, the spacer ring 4 in a region 33 where the shaft 3 or, respectively, the spacer ring 4 is rotatably attached to the support part 81.

A plurality of support parts 81 is coordinated to the spacer rings 4 in each case at a middle position relative to a thickness of the respective spacer ring 4 as shown in FIG. 1.

A sliding coating or a sliding layer 25 (FIG. 3*e*) can be applied onto the support part 81 in the region 33 between the support part 81 and the shaft 3 or, respectively, the spacer ring 4 as shown in FIG. 3*e*. The sliding coating or the sliding layer 25 causes a decreasing of the friction during rotation of the shaft 3 or, respectively, the spacer ring 4.

The stripper part 82, shown in FIG. 3*a*, forming the stripper device, is a functionally independent component, but forms one construction unit with the support part 81. The stripper parts 82 are positioned relative to a respective spacer ring 4 at the lower "dead point" of the spacer rings 4, and the stripper parts 82 are disposed, like the support parts 81, between the disk rotors 5. The stripper part 82 is furnished with a sharpened end to increase a stripping effect.

The support part 81 is preferably attached to the rear wall 11. The concave-curved section of the support part 81 opposes the outer vertical section of the spacer ring 4 and is directed toward the middle of the rotor shear such that the spacer ring is prevented from being forced toward the rear wall. The stripper part 82 preferably narrows from the rear wall 11 toward the concave-curved section. The angular extension of the concave-curved face of the support part can be from about 10 degrees to 60 degrees and is preferably from about 30 to 40 degrees relative to the respective axis of the spacer ring 4.

The stripper part 82 is preferably attached to the rear wall 11. The tip of the stripper part 82 opposes the lower point of the spacer ring 4 and is directed toward the middle of the rotor shear such that materials carried between the two cutting rotors 2 are removed from the respective spacer ring 4. The stripper part 82 preferably narrows from the rear wall 11 toward the tip of the stripper part engaging items carried along by the spacer ring 4.

The support/stripper devices 8 and/or the support parts 81 and stripper parts 82 are supported at the housing 1.

The stripper part 82 can be made as a separate component as shown in FIGS. 3*b*, 3*e* and 3*f*. The stripper part 82 made as a separate part can be adjusted in a height level position relative to the shaft and/or can be disposed swivelingly at the housing 1. The stripper part 82 can also be supported against a spring 26 as illustrated in FIG. 3*f*.

In another embodiment, the support/stripper device 8 is recessed between the support part 81 and the stripper part 82. In this embodiment, the support/stripper device 8, according to FIG. 3*d*, is subdivided by a recess 27, although it is formed as one construction unit, where the stripper part 82 is formed as a springing device component relative to the shaft 3 or, respectively, to the spacer ring 4. The recess 27 can be substituted by two-sided bevelled inclinations with a ridge line running perpendicular to a shaft axis.

The stripper part 82 does not experience a load under a horizontal bending of the shaft 3 upon wear of the support part 81 and does not interfere with the functioning of the support part 81.

Figure 7:
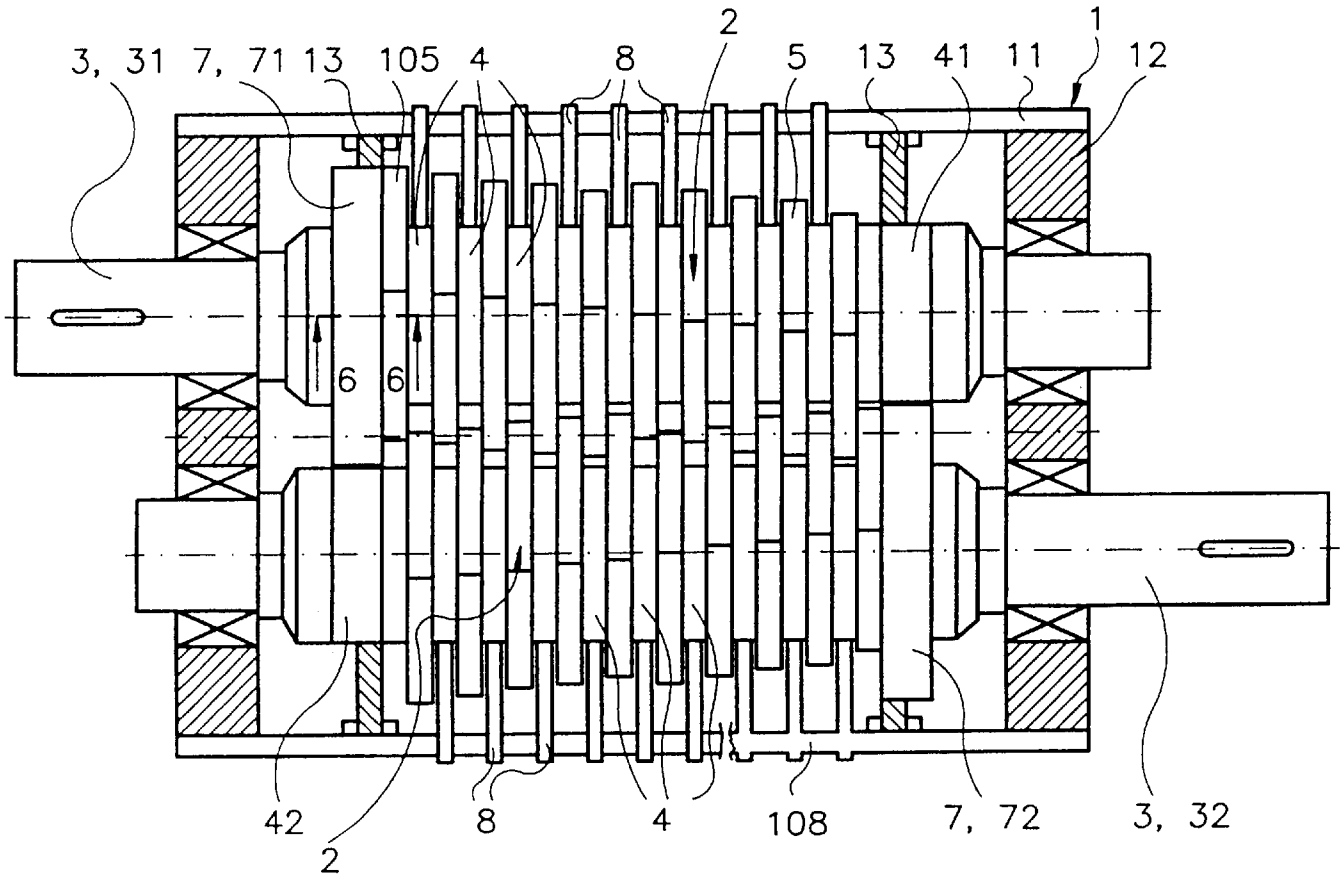
FIG. 7 is schematic top plan view of the open rotor shear with another embodiment of stripper part.

As is shown in FIG. 3*c*, an additional stripper part 83 is furnished for avoiding a jamming of material in case of a reverse operation, which additional stripper part 83 is advantageously swivel-mounted. The additional stripper part 83 is furnished, like the stripper part 82, with a sharpened end which is positioned relative to and above the spacer ring 4 at an upper "dead point" 22 of the spacer ring 4. Each additional stripper part 83 can be disposed relative to a respective spacer ring 4 and the plurality of stripper parts is arranged in a form of a rake 108 as shown in FIG. 7.

These means contribute specifically to a reduction in the wear based on the avoiding of the jamming of the materials to be comminuted, and the features according to the invention furnish a more effective comminuting process, and, in particular, a further increase of the availability of the rotor shears is present.

It is common to all embodiments that the cutting rotors 2 can be demounted from the housing 1 without removing the support/stripper devices 8. According to the materials to be comminuted, different coordinations of the support/stripper devices are possible.

Exchangeable and adaptable parts for the individual comminuting process are employed in each place for obtaining effective embodiments and advantageous arrangements.

Each of the disk rotors 5 exhibits three cutting teeth 6. Preferably, the radial space of the cutting teeth from the rotation axis is equal for all cutting teeth. The faces of the front flanks 61 of the cutting teeth are constructed to further increase and support the availability of the rotor shears such that geometrically staggered and/or inclined partial faces 65 are generated, which lead to a step-by-step comminuting and to an optimum effect of the comminuting edges 62, 63 participating at the comminuting process and of the partial face 65 (FIG. 5*a*, 5*b*, 5*c*, 5*d*). The cutting teeth 6 can be employed with the proposed geometries, which can in each case be coordinated to the material mixture to be comminuted.

Figure 2B:
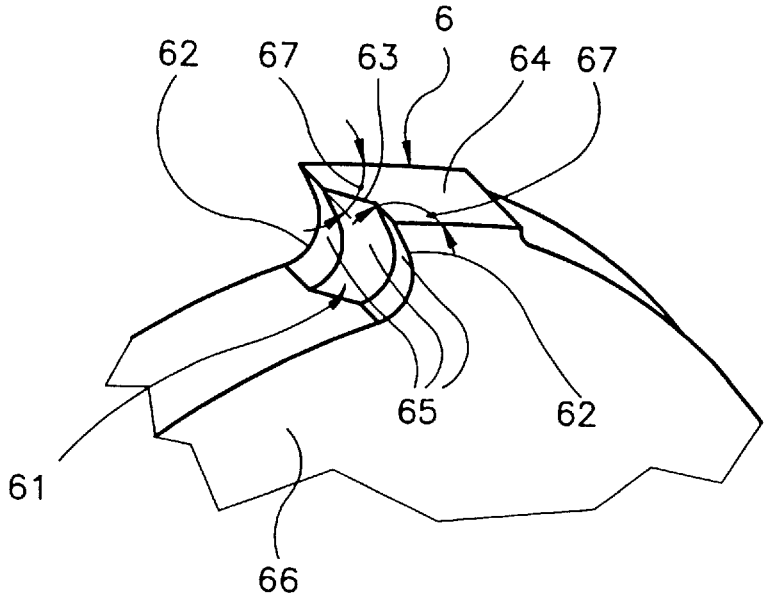
FIG. 2*b* is a fragmentary perspective view of a cutting tooth.

The geometry of a cutting tooth 6 is shown in FIG. 2*b* by way of the example, where the comminuting edges 62 are defined as edges disposed between the front flank 61 of the tooth and side faces 66, which comminuting edges 62 operate in conjunction with the comminuting edges 62 of the cutting tooth 6 of the oppositely disposed rotor disk 5. The comminuting edge 63 is defined as an edge disposed between a tooth head 64 and the front flank 61 of the tooth, which comminuting edge 63 faces the spacer ring 4. Furthermore, the angles are designated with 67, which angles are disposed between the part faces 65 of the front flank 61 of the tooth and the side faces 66, wherein the angles are set at approximately or precisely to 90 degrees according to the embodiment of FIGS. 2, 4*a*, 4*b*, 4*e*, 5*a*, 5*b* and 5*e*, and wherein a slightly smaller angle, such as 89 degrees, can be advantageous under certain circumstances.

Figure 4A:
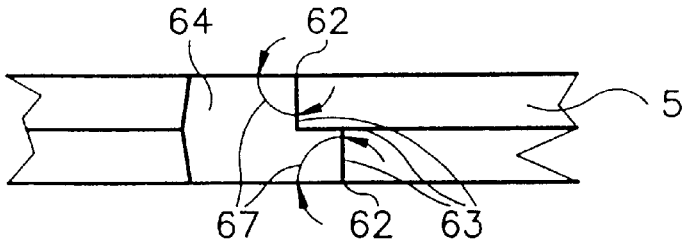
FIG. 4*a* is a partial top view of a first embodiment of the cutting teeth.
Figure 5A:
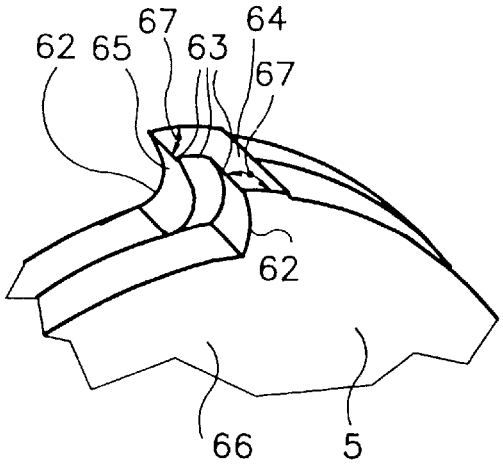
FIG. 5*a* is a fragmentary perspective view of the cutting teeth of FIG. 4*a;*

A first embodiment of the tooth as shown in FIGS. 4*a* and 5*a* exhibits the comminuting edges 63 and partial faces 65 of the front flank 61 of tooth formed staggered like steps. A partial face 65 of a bigger tooth is disposed forward relative to a partial face of a smaller tooth in a rotation direction of the rotor disk.

Figure 4B:
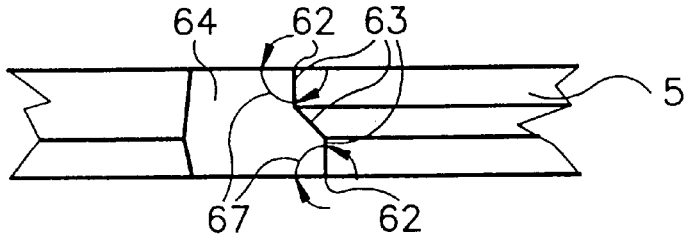
FIG. 4*b* is a partial top view of a second embodiment of the cutting teeth.
Figure 5B:
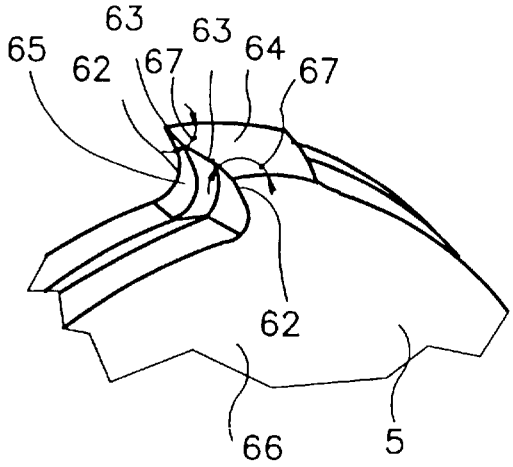
FIG. 5*b* is a fragmentary perspective view, of the cutting teeth of FIG. 4*b;*

The comminuting edges 63, shown in FIGS. 4*b* and 5*b*, and partial faces 65 disposed at sides of the tooth, are staggered nearly perpendicularly like steps relative to the side faces 66 with an intermediately disposed inclined partial face. The inclined partial face connects the partial faces disposed at the sides of the tooth and the tooth is thereby more massive, rigid, and shows resistance to breaking.

Figure 4C:
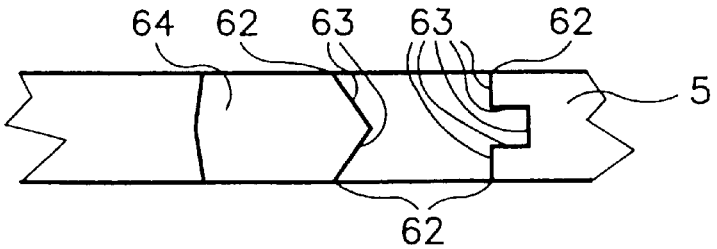
FIG. 4*c* is a partial top view of a third embodiment of the cutting teeth.
Figure 5C:
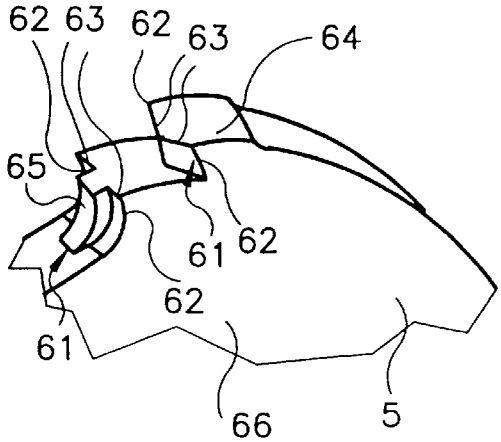
FIG. 5*c* is a fragmentary perspective view of the cutting teeth of FIG. 4*c;*

The comminuting edges 63 of yet another embodiment shown in FIGS. 4*c* and 5*c* and the partial faces 65 of the front flank 61 of the tooth are formed nearly concave, nearly like a wedge, for furnishing predominantly a cutting effect. A part of the tooth disposed near a tooth base has the partial faces 65 exhibiting a U-shaped nose disposed approximately in the middle of the front flank. The other part of the tooth has the partial faces inclined relative to each other such that the comminuting edges 63 form a shape of the letter of V.

Figure 4D:
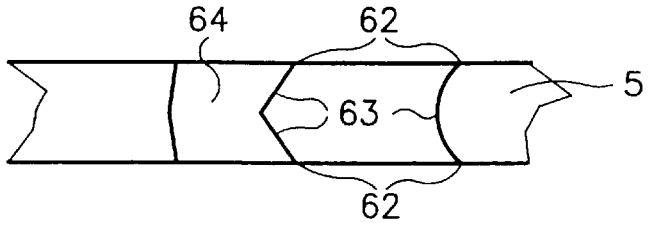
FIG. 4*d* is a partial top view of a fourth embodiment of the cutting teeth.
Figure 5D:
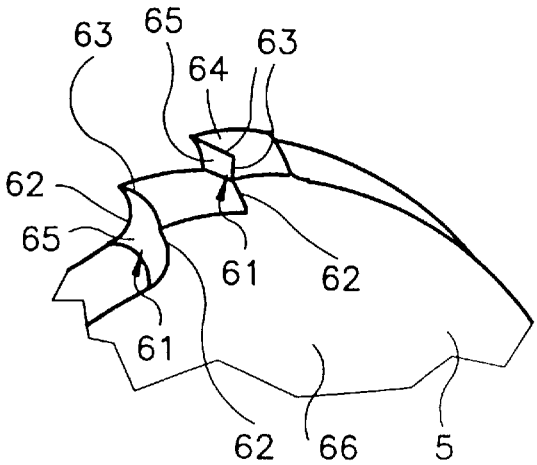
FIG. 5*d* is a fragmentary perspective view of the cutting teeth of FIG. 4*d*.

The comminuting edges 63 of an another embodiment shown in FIGS. 4*d* and 5*d* and the partial faces 65 of the front flank 61 of the tooth are formed convex for generating predominantly a breaking effect. A part of the tooth disposed near a tooth base exhibits a rounded partial face 65. The other part of the tooth has the partial faces 65 inclined relative to each other and a recess is formed in the middle of the tooth. Outer edges of the other part of the tooth stand out in a rotation direction of the rotor disk. In case of the embodiments of FIGS. 4*c*, 4*d*, 5*c*, 5*d*, it is possible to exchange the comminuting edges shown in their relative position.

The basic functions of breaking/cutting are effected step by step, wherein the breaking functions or the cutting functions are dominating in the embodiments shown in FIGS. 4*c*, 5*c*, 4*d* and 5*d*. Based on the embodiment of the cutting teeth 6 with the pulled-in front flank 61 of the tooth and the back step after the tooth head 64 to the non-designated rear flank of the tooth, there remains advantageously an effective residual cutting tooth even after an eventual breaking of a part of the tooth based on the prevailing cross-section relationships.

Figure 4E:
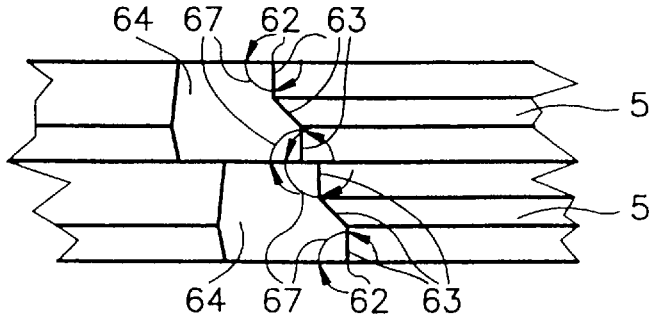
FIG. 4*e* is a partial top view of a fifth embodiment of the cutting teeth.
Figure 5E:
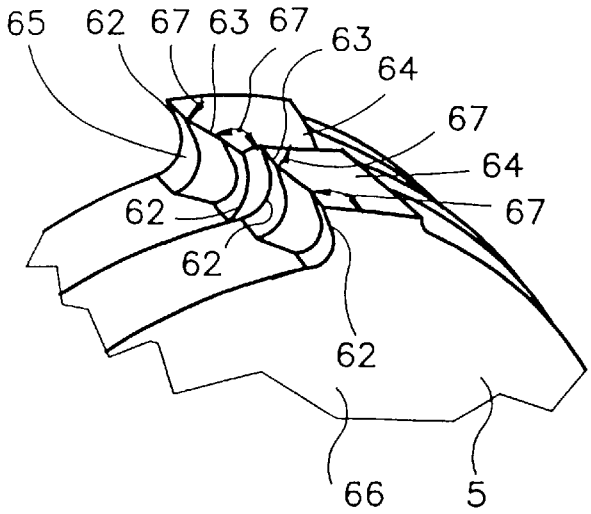
FIG. 5*e* is a fragmentary perspective view of the cutting teeth of FIG. 4*e*.

A preferred embodiment is shown in FIGS. 4*e* and 5*e*, wherein the device unit includes at least two rotor disks 5 and staggered cutting teeth 6. After wear of the outer cutting edges 62, 63, the rotor disks 5 can furthermore advantageously be composed and again be used and employed at the front sides 66 of the worn comminuting edges 62, 63. In addition, thicker constructions of rotor disks 5, based on combining a plurality of individual rotor disks, can be produced universally and easily for a corresponding comminuting process.

The rotor shear as described with the embodiments presented can be adjusted optimally for cutting, breaking and crushing the materials which are to be comminuted.

It will be understood that each of the elements described above, or two or more together, may also find a useful application in other types of a rotor shears differing from the types described above.

While the invention has been illustrated and described as embodied in the context of a rotor shear for comminuting waste material, it is not intended to be limited to the details shown, since other embodiments are possible, which realize in particular the functional cooperation of the individual features of the invention for increasing the availability of a rotor shear, such as coupling of the wear disk 7 to an outer rotor disk 5, the coordination of support/stripper devices 8 to the cutting rotor 2, and geometrically staggered and/or angled partial faces 65 of the front tooth flank 61 of the cutting teeth 6, disposed on the rotor disk 5, and since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rotor shear for comminuting bulky waste materials comprising:

a housing divided into a comminuting chamber and a non-comminuting chamber by a separating wall having an opening defined therethrough;

a first shaft supported in said housing and driven in a first direction of rotation;

a second shaft supported in said housing, disposed parallel to said first shaft, and driven in a second direction of rotation opposite to said first direction of rotation;

a first plurality of rotor disks with cutting teeth, said first plurality of rotor disks being disposed on said first shaft and including an outer rotor disk;

a second plurality of rotor disks with cutting teeth, said second plurality of rotor disks being disposed on said second shaft said first and second plurality of rotor disks being offset relative to one another in an axial direction;

a first wear disk attached to one end of said first shaft proximate said outer rotor disk of said first plurality of rotor disks and having a radius at least equal to a radius of said outer rotor disk, said first wear disk being received through the opening in the separating wall; and an outer spacer ring mounted on said second shaft, wherein said first wear disk contacts said outer spacer ring of said second shaft so as to reduce axial forces on said first shaft.

2. The rotor shear for comminuting bulky waste materials according to claim 1, further comprising at least one support device associated with one of said shafts, said at least one support device being autonomous of the shafts, wherein said support device is positioned relative to said one shaft in a sector between a lowest point and a horizontal symmetry line of said one shaft.

3. The rotor shear for comminuting bulky waste materials according to claim 1, further comprising at least one stripper device associated with one of said shafts, said at least one stripper device being autonomous of said shafts, wherein said stripper device is disposed relative to said one shaft in a sector proximate a lowest point of said one shaft.

4. The rotor shear for comminuting bulky waste materials according to claim 1, wherein at least one of the cutting teeth of said first and second plurality of rotor disks has a front flank including geometrically staggered partial faces forming comminuting edges to provide optimized step-by-step comminution of said bulky waste.

5. The rotor shear for comminuting bulky waste materials according to claim 1, wherein at least one of the cutting teeth of said first and second plurality of rotor disks has a front flank including angled partial faces forming comminuting edges to provide optimized step-by-step comminution of said bulky waste.

6. The rotor shear for comminuting bulky waste materials according to claim 1, wherein said first wear disk is shape-matchingly attached to said first shaft.

7. The rotor shear for comminuting bulky waste materials according to claim 1, wherein said first wear disk is force-matchingly attached to said first shaft.

8. The rotor shear for comminuting bulky waste materials according to claim 1, wherein said first wear disk is attached to said first shaft by a thread.

9. The rotor shear for comminuting bulky waste materials according to claim 1, wherein said first wear disk forms a collar-like part of said first shaft.

10. The rotor shear for comminuting bulky waste materials according to claim 1, wherein said first wear disk forms a flange-like part of said first shaft.

11. The rotor shear for comminuting bulky waste materials according to claim 1, further comprising a second wear disk connected to said first shaft, wherein said second wear disk rotates with its periphery facing a second outer spacer ring of said second shaft.

12. The rotor shear for comminuting bulky waste materials according to claim 1, further comprising a support/stripper device, including a support part and a stripper part integrated into a unitary device wherein said support part and said stripper part are functionally decoupled.

13. The rotor shear for comminuting bulky waste materials according to claim 12, wherein said support part is disposed substantially centered axially on said first shaft.

14. The rotor shear for comminuting bulky waste materials according to claim 12, further comprising a plurality of support parts substantially uniformly disposed axially on said first shaft.

15. The rotor shear for comminuting bulky waste materials according to claim 12, further comprising a sliding layer applied to said support part.

16. The rotor shear for comminuting bulky waste materials according to claim 12, further comprising:

a spacer ring mounted on said second shaft; and a sliding layer applied to said spacer ring.

17. The rotor shear for comminuting bulky waste materials according to claim 12, wherein said stripper part is disposed substantially centered axially on said first shaft.

18. The rotor shear for comminuting bulky waste materials according to claim 12, further comprising a plurality of stripper parts substantially uniformly disposed axially on said first shaft.

19. The rotor shear for comminuting bulky waste materials according to claim 12, wherein said stripper part is substantially free of a load upon a horizontal bending of said first shaft and operation of said stripper part is not effected upon wear of said support part.

20. The rotor shear for comminuting bulky waste materials according to claim 12, wherein said stripper part is adjustably mounted on said housing to change its position relative to an axis of said first shaft.

21. The rotor shear for comminuting bulky waste materials according to claim 12, further comprising a spring supporting said stripper part.

22. The rotor shear for comminuting bulky waste materials according to claim 12, wherein said stripper part is a spring device.

23. The rotor shear for comminuting bulky waste materials according to claim 12, wherein said support/stripper device has a recess defined between said support part and said stripper part on a side of said support/stripper device disposed proximate an axis of said first shaft.

24. The rotor shear for comminuting bulky waste materials according to claim 12, wherein said support/stripper device has two-sided beveled inclinations with a ridge line running substantially perpendicular to an axis of said first shaft between said support part and said stripper part on a side of said support/stripper device disposed proximate an axis of rotation of said first shaft.

25. The rotor shear for comminuting bulky waste materials according to claim 12, further comprising an additional stripper part disposed in a sector adjoining an upper "dead point" of said first shaft for allowing a reverse operation.

26. The rotor shear for comminuting bulky waste materials according to claim 25, wherein said additional stripper part is formed like a rake.

27. The rotor shear for comminuting bulky waste materials according to claim 12, wherein said support/stripper device is supported by said housing.

28. The rotor shear for commuinuting bulky waste materials according to claim 1, further comprising a tooth disposed on one of said first plurality of rotor disks, said tooth having a front flank including comminuting edges and partial faces staggered like steps.

29. The rotor shear for comminuting bulky waste materials according to claim 1, further comprising a tooth disposed on one of said first plurality of rotor disks, said tooth having a front flank including comminuting edges and partial faces staggered nearly parallel like steps relative to a front face with an intermediately disposed inclined partial face.

30. The rotor shear for comminuting bulky waste materials according to claim 1, further comprising a tooth disposed on one of said first plurality of rotor disks, said tooth having a front flank including comminuting edges and convex partial faces for a predominant breaking effect on waste material to be comminuted.

31. The rotor shear for comminuting bulky waste materials according to claim 1, further comprising a tooth disposed on one of said first plurality of rotor disks, said tooth having a front flank including comminuting edges and nearly concave partial faces formed like a wedge for a predominant cutting effect on waste material to be comminuted.

32. The rotor shear for comminuting bulky waste materials according to claim 1, further comprising a plurality of cutting teeth disposed on one of said first plurality of rotor disks, wherein each of said plurality of cutting teeth includes comminuting edges and partial faces.

33. The rotor shear for comminuting bulky waste materials according to claim 1, wherein at least two rotor disks are integrated as a unitary device.

34. The rotor shear for comminuting bulky waste materials according to claim 1, further comprising a plurality of cutting teeth disposed on one of said first plurality of rotor disks, wherein said cutting teeth are staggered in a circumferential direction.

35. The rotor shear for comminuting bulky waste materials according to claim 1, further comprising a tooth disposed on one of said first plurality of rotor disks and a front flank having partial faces and front sides at approximately 90 degrees relative to one another.

36. The rotor shear for comminuting bulky waste materials according to claim 1, wherein said first plurality of rotor disks are grouped into a construction unit, said group of said first plurality of rotor disks being interchangeable, after a wear of an outer comminuting edge, inside out with adjoining front faces of worn outer comminuting edges.

37. A rotor shear for comminuting bulky waste materials comprising:

a housing;

a first shaft supported in said housing and driven in a first direction of rotation;

a second shaft supported in said housing, disposed parallel to said first shaft, and driven in a second direction of rotation opposite to said first direction of rotation;

a first plurality of rotor disks with cutting teeth, said first plurality of rotor disks being disposed on said first shaft and including an outer rotor disk;

a second plurality of rotor disks with cutting teeth, said second plurality of rotor disks being disposed on said second shaft, wherein at least one of the cutting teeth of said first and second plurality of rotor disks has a front flank including geometrically staggered partial faces forming comminuting edges to provide optimized step-by-step comminution of said bulky waste;

a wear disk attached to one end of said first shaft proximate said outer rotor disk of first plurality of rotor disks and having a radius at least equal to a radius of said outer rotor disk;

at least one support device connected to one of said first shaft and said second shaft, said at least one support device being autonomous of the shafts, wherein said support device is positioned relative to said one shaft in a sector between a lowest point and a horizontal symmetry line of said one shaft;

at least one stripper device connected to one of said first shaft and said second shaft, said at least one stripper device being autonomous of said shafts, wherein said stripper device is disposed relative to said one of said first shaft and said second shaft in a sector proximate a lowest point of said one of said first shaft and said second shaft; and wherein at least one of the cutting teeth of said first and second plurality of rotor disks includes geometrically staggered partial faces and comminuting edges to provide optimized step-by-step comminution of said bulky waste.

* * * * *